US006250892B1

(12) United States Patent
Kato et al.

(10) Patent No.: US 6,250,892 B1
(45) Date of Patent: Jun. 26, 2001

(54) REFRIGERANT SUCTION STRUCTURES FOR COMPRESSORS

(75) Inventors: Keiichi Kato; Hajime Kurita; Hirotaka Kurakake; Masaki Ota, all of Aichi-ken (JP)

(73) Assignee: Toyoda Automatic Loom Works, Ltd., Kariya (JP)

( * ) Notice: Subject to any disclaimer, the term of this patent is extended or adjusted under 35 U.S.C. 154(b) by 0 days.

(21) Appl. No.: 09/280,511

(22) Filed: Mar. 30, 1999

(30) Foreign Application Priority Data

Mar. 30, 1998 (JP) ..... 10-083721

(51) Int. Cl.[7] ..... F04B 1/12; F04B 27/08
(52) U.S. Cl. ..... 417/269
(58) Field of Search ..... 417/269, 222.2

(56) References Cited

U.S. PATENT DOCUMENTS

| | | | |
|---|---|---|---|
| 4,392,788 | 7/1983 | Nakamura et al. | 417/269 |
| 4,415,315 | 11/1983 | Shibuya | 417/269 |
| 5,518,374 | 5/1996 | Ota et al. | 417/222.2 |
| 5,674,054 | 10/1997 | Ota et al. | 417/269 |
| 5,741,122 | 4/1998 | Yokono et al. | 417/222.2 |
| 6,048,178 * | 4/2000 | Kawaguchi et al. | 417/222.2 |

FOREIGN PATENT DOCUMENTS

| | | |
|---|---|---|
| 56-69476 | 6/1981 | (JP) . |
| 64-56583 | 3/1995 | (JP) . |

OTHER PUBLICATIONS

EP 99 10 5330 Search Report dated Apr. 27, 2000.

* cited by examiner

*Primary Examiner*—Teresa Walberg
*Assistant Examiner*—Vinod D. Patel
(74) *Attorney, Agent, or Firm*—Fitzpatrick, Cella, Harper & Scinto

(57) ABSTRACT

Suction ports corresponding to individual cylinder bores are formed in a partition plate. A refrigerant feeder channel is provided on a rear wall of a rear housing whose internal space is partitioned chiefly into a suction chamber and a discharge chamber. A structural wall of the refrigerant feeder channel constitutes an integral part of the rear housing. The refrigerant feeder channel is formed from an outer cylindrical wall of the rear housing, extends across the discharge chamber and opens into the suction chamber. An outflow opening of the refrigerant feeder channel has a slanting edge so that it opens toward the partition plate. The outflow opening is so positioned that its center lies on an axis of a rotary shaft.

44 Claims, 5 Drawing Sheets

REFRIGERANT SUCTION STRUCTURES FOR COMPRESSORS

BACKGROUND OF THE INVENTION

1. Field of the Invention

The present invention relates to refrigerant suction structures for a compressor. More particularly, the present invention relates to refrigerant suction structures for a compressor in which a plurality of suction ports are formed in a partition plate which separates a plurality of cylinder bores arranged in a circular form around a longitudinal axis of a rotary shaft from a suction chamber. Compressing elements fitted in the cylinder bores are caused to move by rotating motion of the rotary shaft, and a refrigerant is introduced from the suction chamber into the individual cylinder bores through the suction ports. Refrigerant is expelled from the cylinder bores into a discharge chamber formed around the outer periphery of the suction chamber as a result of movements of the compressing elements.

2. Description of the Related Art

In a compressor disclosed in Japanese Unexamined Patent Publication No. 56-69476, a cam plate compartment accommodating a cam plate constitutes part of a suction passage and a refrigerant taken into the cam plate compartment is introduced into a suction chamber formed in a housing which extends from the front to the rear of a cylinder block. The refrigerant in the suction chamber is drawn into cylinder bores through suction holes formed in a side plate with a suction action of each piston, and the refrigerant in the cylinder bores is driven out into a discharge chamber in the housing through discharge holes formed in the side plate with a discharge action of each piston.

In this example of prior art technology, the discharge chamber surrounds the outer periphery of the suction chamber and the refrigerant in the cam plate compartment is introduced into the suction chamber through the holes in the side plate. The suction passage extending from the outside of the compressor to the cylinder bores is bent or curved, and such meandering part of the suction passage causes pressure loss. The pressure loss in the suction passage impedes smooth introduction of the refrigerant into the cylinder bores, resulting in a reduction in volumetric efficiency with respect to the refrigerant.

SUMMARY OF THE INVENTION

It is an object of the present invention to provide refrigerant suction structures which can reduce pressure loss in a suction passage running from the outside of a compressor to its cylinder bores.

The refrigerant suction structures of the invention are intended to be incorporated in a compressor in which a plurality of suction ports are formed in a partition plate which separates a plurality of cylinder bores arranged in a circular form around a longitudinal axis of a rotary shaft from a suction chamber. Compressing elements fitted in the cylinder bores are caused to move by rotating motion of the rotary shaft, and a refrigerant is introduced from the suction chamber into the individual cylinder bores through the suction ports. Refrigerant is expelled from the cylinder bores into a discharge chamber formed around the outer periphery of the suction chamber as a result of movements of the compressing elements.

According to a principal aspect of the invention, a refrigerant feeder for feeding a suction chamber with a gaseous refrigerant to be compressed is formed so as to extend across the discharge chamber and to open into the suction chamber from an outer periphery of the suction chamber.

This makes it possible to form the refrigerant feeder channel running from the outside of the compressor to the suction chamber in a straight or substantially straight line. This structure of the refrigerant feeder channel helps decrease pressure loss in a suction passage inside the compressor that connects an external refrigerant circuit to the suction chamber.

In another aspect of the invention, the refrigerant feeder channel projects from a side wall of the suction chamber with an outflow opening of the refrigerant feeder channel directed toward the center of a circle along which the suction ports are arranged in the circular form.

This structure employing the refrigerant feeder channel projecting from the side wall of the suction chamber helps decrease differences in the distances from the individual suction ports to the outflow opening of the refrigerant feeder channel and uniformly reduce the pressure loss when the refrigerant flows into the individual cylinder bores.

In still another aspect of the invention, the outflow opening of the refrigerant feeder channel is provided at a position corresponding to the center of the circle along which the suction ports are arranged in the circular form.

In this structure, the distances from the individual suction ports to the outflow opening of the refrigerant feeder channel become nearly the same and pressure variations at the outflow opening are minimized. This helps reduce acoustic noise caused by suction pressure pulsation which would be transmitted through the refrigerant feeder channel to the external refrigerant circuit.

In yet another aspect of the invention, the outflow opening of the refrigerant feeder channel has a slanting edge so that it opens toward the partition plate.

The slanting edge of the outflow opening serves to reduce the pressure loss.

In a further aspect of the invention, the refrigerant feeder channel is formed along an inside surface of a rear wall of the suction chamber.

This construction of the refrigerant feeder channel is effective for minimizing the pressure loss.

In a still further aspect of the invention, a structural wall of the refrigerant feeder channel is formed as an integral part of the rear wall of the suction chamber.

This kind of one-piece construction is advantageous from the viewpoint of case of manufacture and production cost.

In a further aspect of the invention, there are formed a plurality of retaining projections on the inside surface of the rear wall of the suction chamber. These retaining projections are arranged in a circular configuration and press the partition plate toward the cylinder bores. The outflow opening of the refrigerant feeder channel is provided inside a circle along which the retaining projections are arranged so that no retaining projections are located between the outflow opening and the individual suction ports.

A pushing force exerted by the multiple retaining projections prevents leakage of the refrigerant from the cylinder bores along the partition plate. This structure in which the outflow opening of the refrigerant feeder channel is located inside the circle along which the retaining projections are arranged reduces the influence of the retaining projections on the flow of the refrigerant from the outflow opening to the suction ports.

In a further aspect of the invention, there is formed a swollen part bulging out into the suction chamber on its rear wall in such a way that an area of the inside surface of the rear wall of the suction chamber extended from the refrigerant feeder channel intersects the swollen part.

The swollen part serves to smooth out refrigerant streams flowing from the outflow opening of the refrigerant feeder channel to the suction ports.

In another aspect of the invention, the compressor is a variable displacement compressor in which the refrigerant is supplied from a discharge pressure region to a controlled pressure chamber and drawn out of the controlled pressure chamber into a suction pressure region, and the displacement capacity of the compressor is varied according to the difference between controlled pressure in the controlled pressure chamber and suction pressure in the suction pressure region, wherein a capacity control valve is used for controlling operation at least for supplying the refrigerant from the discharge pressure region to the controlled pressure chamber or for drawing out the refrigerant from the controlled pressure chamber into the suction pressure region.

The present invention is preferable for embodying in this kind of variable displacement compressor.

In a further aspect of the invention, the capacity control valve is accommodated in a compartment formed in the rear wall of the suction chamber, and a structural wall of the compartment constitutes the aforementioned swollen part, wherein the area of the inside surface of the rear wall extended from the refrigerant feeder channel intersects the structural wall of the compartment.

The structural wall of the compartment serves to smooth out the refrigerant streams flowing from the outflow opening of the refrigerant feeder channel to the suction ports.

In a yet further aspect of the invention, the compressor is provided with a fixing part which is used for mounting the compressor to an external structure, a portion of the fixing part forming a swollen part on the rear wall of the suction chamber, wherein an area of the inside surface of the rear wall extended from the refrigerant feeder channel intersects the fixing part.

According to this structure, the aforementioned portion of the fixing part serves to smooth out the refrigerant streams flowing from the outflow opening of the refrigerant feeder channel to the suction ports.

It will become more apparent from the following detailed description and drawings that the present invention provides refrigerant suction structures which can reduce pressure loss in the suction passage running from the outside of the compressor to its cylinder bores, because there is formed the refrigerant feeder channel which extends across the discharge chamber from the outer periphery of the suction chamber and opens into the suction chamber.

BRIEF DESCRIPTION OF THE DRAWINGS

The foregoing summary, as well as the following detailed description of the preferred embodiments, is better understood when read in conjunction with the appended drawings. For the purpose of illustrating the invention, there is shown in the drawings an exemplary embodiment that is presently preferred, it being understood, however, that the invention is not limited to the specific methods and instrumentalities disclosed. In the drawings:

FIG. 5(*b*) is a cross-sectional view taken along lines D—D of FIG. 5(*a*);

DETAILED DESCRIPTION OF THE PREFERRED EMBODIMENTS

A variable displacement compressor according to a first exemplary embodiment of the invention, which is preferably installed on a motor vehicle, is now described with reference to FIGS. 1 to 4.

Figure 1:
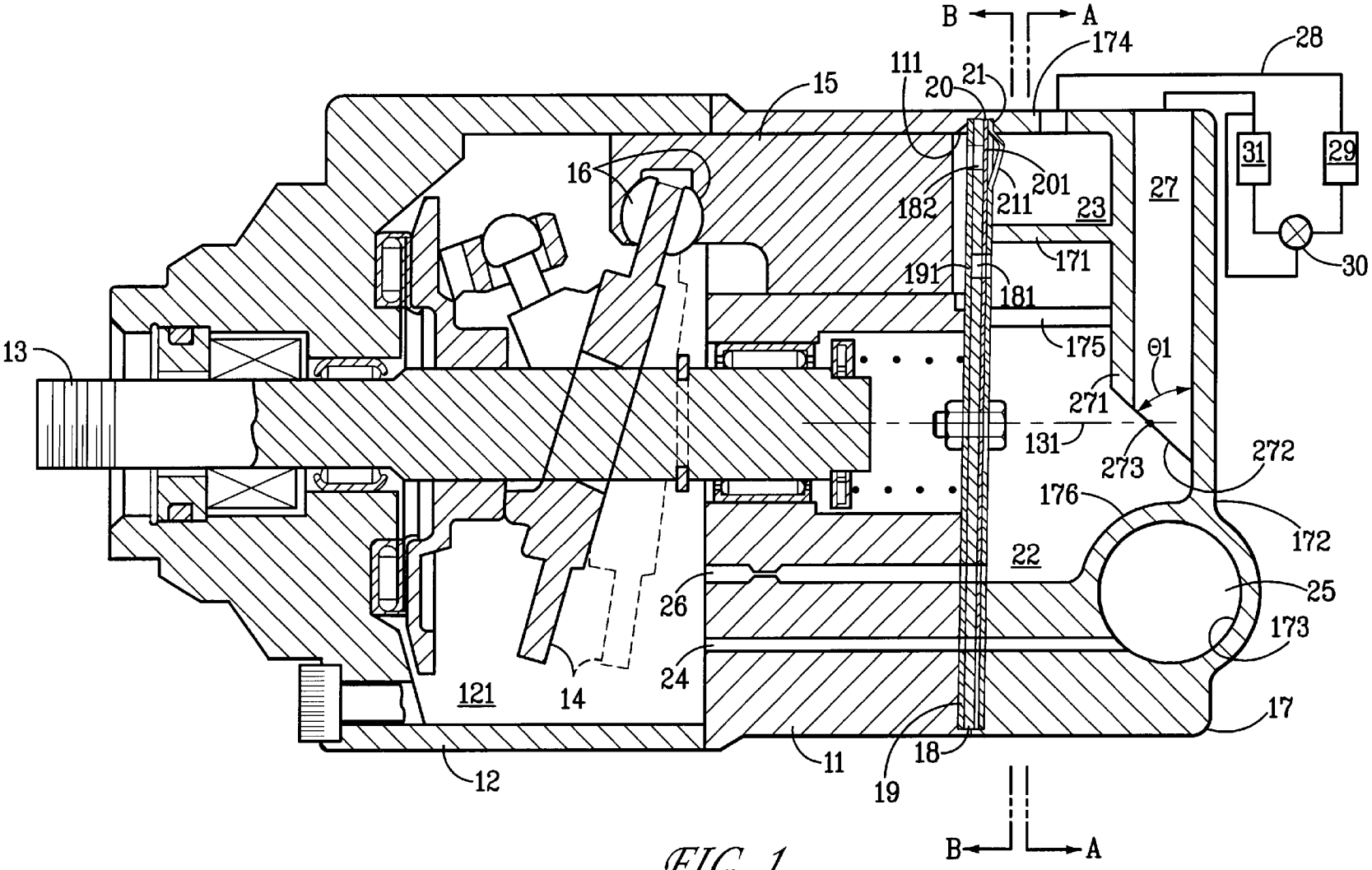
FIG. 1 is a cross-sectional side view of a compressor according to a first exemplary embodiment of the invention.

Referring to FIG. 1, a rotary shaft 13 supported by a cylinder block 11 and a front housing 12 which forms a controlled pressure chamber 121 receives a rotational driving force from a vehicle engine (not shown). A cam plate 14 is supported by the rotary shaft 13 in a manner that the cam plate 14 can be rotated integrally with and inclined relative to the rotary shaft 13. A plurality of cylinder bores 111 are formed in the cylinder block 11 around a longitudinal axis 131 of the rotary shaft 13. Pistons 15, serving as compressing elements, are fitted in the cylinder bores 111 arranged around the rotary shaft 13. Rotary motion of the cam plate 14 is converted into reciprocating motion of the pistons 15 via shoes 16.

Figure 2:
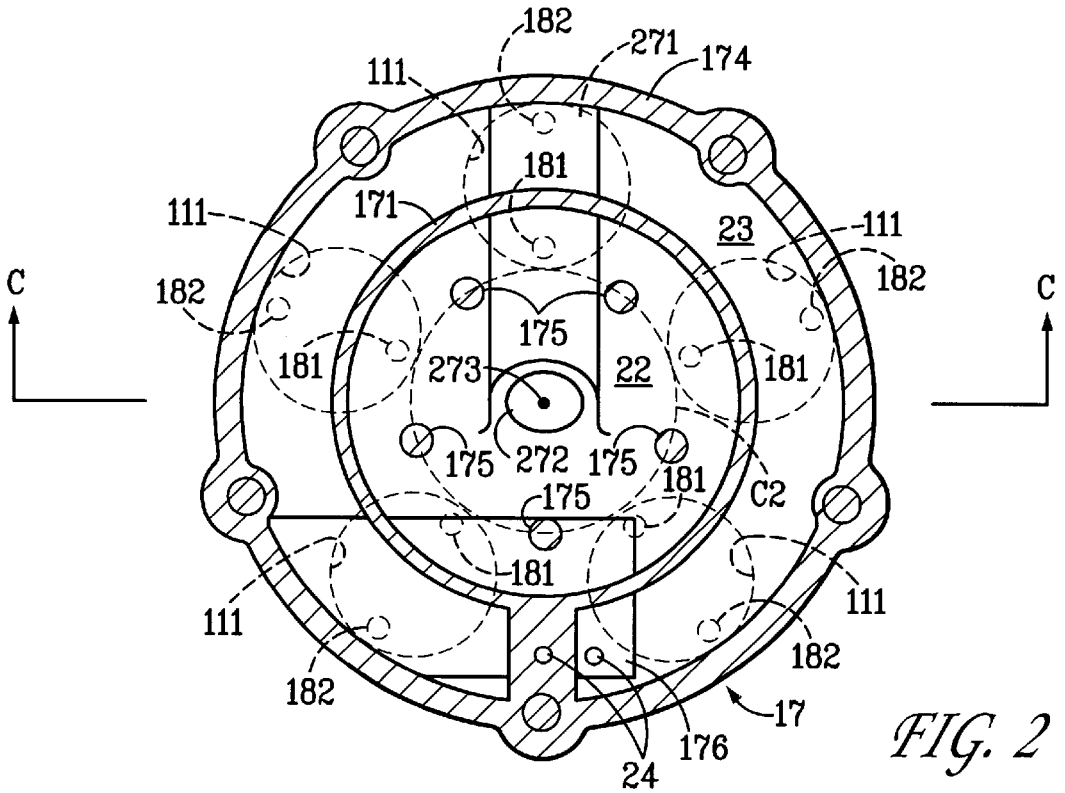
FIG. 2 is a cross-sectional view taken along lines A—A of FIG. 1.
Figure 4:
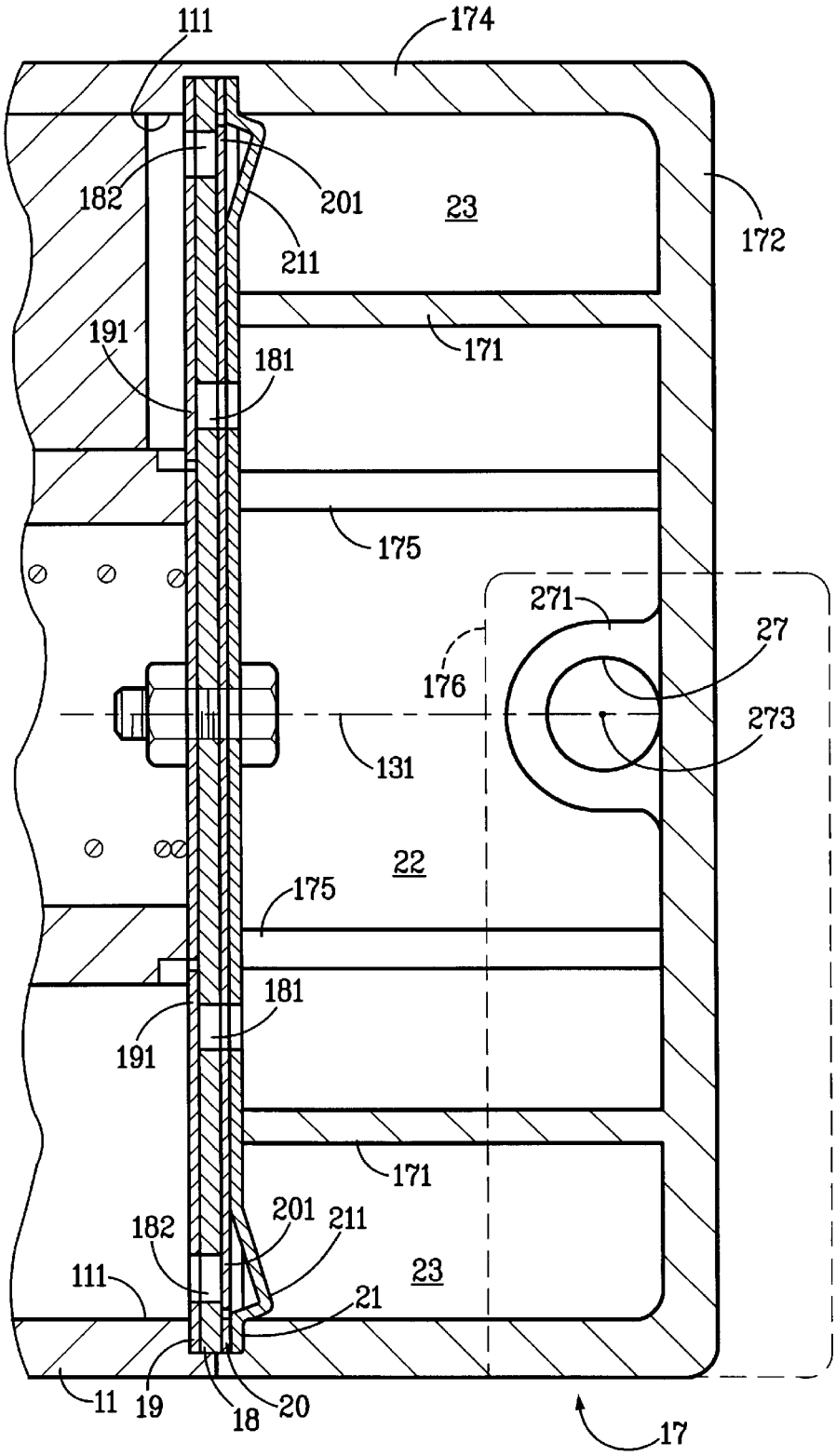
FIG. 4 is an enlarged cross-sectional view taken along lines C—C of FIG. 2.

A rear housing 17 is joined to the cylinder block 11 with a partition plate 18, valve-forming plates 19, 20 and a retainer-forming plate 21 placed in between. A suction chamber 22 and a discharge chamber 23 separated from each other are formed in the rear housing 17. As shown in FIGS. 2 and 4, the suction chamber 22 and the discharge chamber 23 are separated by a cylindrical partition 171 extending from a rear wall 172 of the rear housing 17, wherein the discharge chamber 23 surrounds the outer periphery of the suction chamber 22.

Figure 3:
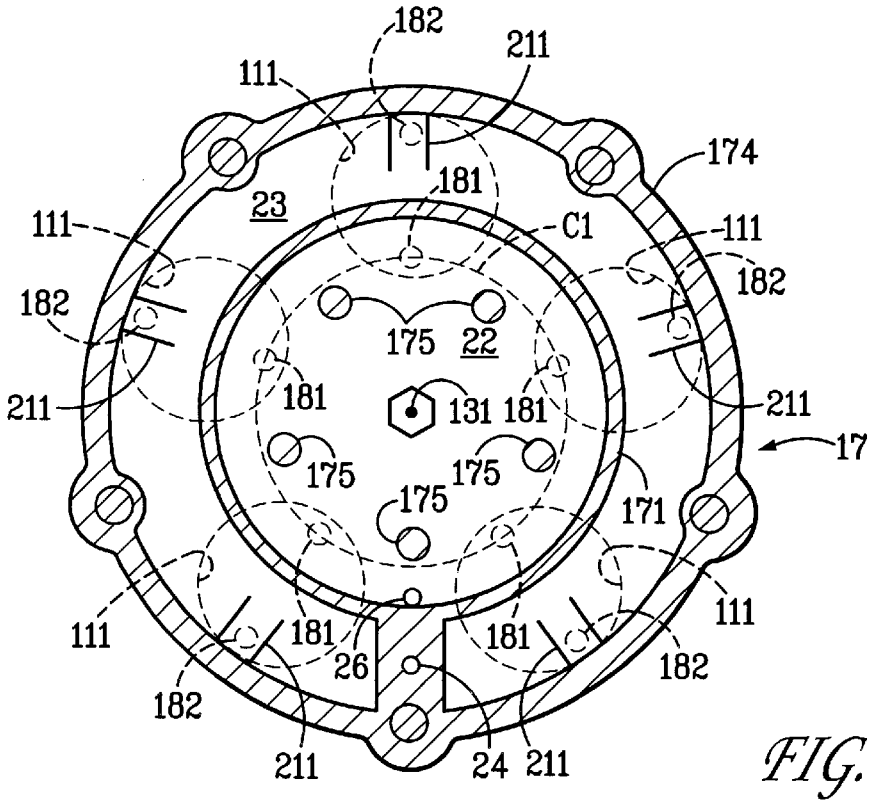
FIG. 3 is a cross-sectional view taken along lines B—B of FIG. 1.

As shown in FIGS. 3 and 4, a plurality of suction ports 181 corresponding to the individual cylinder bores 111 are formed in the partition plate 18 inside the cylindrical partition 171 which serves as a side wall of the suction chamber 22. These suction ports 181 are arranged along a circle C1 whose center is on the axis 131 of the rotary shaft 13 as shown in FIG. 3. There are also formed a plurality of discharge ports 182 in the partition plate 18 outside the cylindrical partition 171 corresponding to the individual cylinder bores 111. Suction valves 191 and discharge valves 201 are formed in the valve-forming plate 19 and the valve-forming plate 20, respectively. Each suction valve 191 opens and closes its corresponding suction port 181 while each discharge valve 201 opens and closes its corresponding discharge port 182.

An electromagnetic open/close valve 25 is provided in a pressure supply channel 24 which interconnects the discharge chamber 23 and the controlled pressure chamber 121. The pressure supply channel 24 supplies a refrigerant from the discharge chamber 23 to the controlled pressure chamber 121. The electromagnetic open/close valve 25 acting as a capacity control valve is excited and de-excited by a controller (not shown). More particularly, the controller controls excitation and de-excitation of the electromagnetic open/close valve 25 based on interior temperature of the vehicle detected by an interior temperature sensor (not shown) and target interior temperature set by an interior temperature setter (not shown). The electromagnetic open/close valve 25 is accommodated in a compartment 173 formed in the rear wall 172. A structural wall 176 of the compartment 173 bulges out into both the suction chamber 22 and the discharge chamber 23 forming a protruding or swollen part.

The refrigerant in the controlled pressure chamber 121 flows into the suction chamber 22 through a pressure release channel 26. The refrigerant in the discharge chamber 23 is not sent to the controlled pressure chamber 121 when the electromagnetic open/close valve 25 is in its non-excited state. Therefore, the difference between controlled pressure in the controlled pressure chamber 121 and suction pressure acting on the individual pistons 15 decreases so that the cam plate 14 is set to its maximum angle of inclination. When the electromagnetic open/close valve 25 is in its excited state, the refrigerant in the discharge chamber 23 is supplied to the controlled pressure chamber 121 through the pressure supply channel 24. In this case, the difference between the controlled pressure in the controlled pressure chamber 121 and the suction pressure acting on the individual pistons 15 increases so that the cam plate 14 is brought to its minimum angle of inclination.

There are formed a plurality of retaining projections 175 on the inside of the rear wall 172 of the rear housing 17. These retaining projections 175 are arranged in a circular configuration around the axis 131 of the rotary shaft 13. As the far end of each retaining projection 175 is in direct contact with the retainer-forming plate 21, the partition plate 18, the valve-forming plates 19, 20 and the retainer-forming plate 21 are forced against an end surface of the cylinder block 11 by the retaining projections 175. The retaining projections 175 are arranged along a circle C2 whose center is on the axis 131 of the rotary shaft 13, as shown in FIG. 3. An outflow opening 272 of a refrigerant feeder channel 27 is provided inside the circle C2 so that none of the retaining projections 175 is positioned between the outflow opening 272 and the suction ports 181.

The refrigerant feeder channel 27 is provided on the inside of the rear wall 172 of the rear housing 17. A structural wall 271 of the refrigerant feeder channel 27 is preferably formed as an integral part of the rear housing 17. Formed from an outer cylindrical wall 174 of the rear housing 17, the refrigerant feeder channel 27 extends across the discharge chamber 23 and opens into the suction chamber 22. The outflow opening 272 of the refrigerant feeder channel 27 preferably has a slanting edge so that it opens toward the partition plate 18. The slant angle 01 of the outflow opening 272 preferably being set to about 45°. The outflow opening 272 is preferably located so that its center 273 lies on the axis 131 of the rotary shaft 13. An inside surface area of the rear wall 172 of the rear housing 17 existing at an extended region of the refrigerant feeder channel 27 intersects the structural wall 176 of the compartment 173.

As the individual pistons 15 move back and forth, the refrigerant in the suction chamber 22, which constitutes a suction pressure region, pushes out the suction valves 191 and the refrigerant flows into the cylinder bores 111 through the respective suction ports 181. The refrigerant thus introduced into the cylinder bores 111 pushes out the discharge valves 201 and is forced out through the discharge ports 182 into the discharge chamber 23, which constitutes a discharge pressure region, as a result of the reciprocating motion of the pistons 15. The opening of the discharge valves 201 is constrained by retainers 211 formed on the retainer-forming plate 21. The refrigerant in the discharge chamber 23 is returned to the suction chamber 22 through a condenser 29, an expansion valve 30 and an evaporator 31 provided in an external refrigerant circuit 28 and the refrigerant feeder channel 27.

A first exemplary embodiment described hereinbefore provides the following advantageous effects:

(1-1) The refrigerant feeder channel 27 which introduces the refrigerant in a substantially straight line from the external refrigerant circuit 28 provided outside the compressor into its internal suction chamber 22. This construction reduces pressure loss in a suction passage inside the compressor that connects the external refrigerant circuit 28 to the suction chamber 22. Such reduction in pressure loss in the suction passage between the outside of the compressor and the suction chamber 22 serves to smoothly introduce the refrigerant into the individual cylinder bores 111 and improve volumetric efficiency with respect to the refrigerant.

(1-2) The center 273 of the outflow opening 272 of the refrigerant feeder channel 27 is located proximate, preferably on, the axis 131 on which the center of the circle C1 defining the circular arrangement of the plurality of suction ports 181 lies. With this positioning of the outflow opening 272 in the suction chamber 22, which can be regarded generally as a cylindrical cavity, the distances from the individual suction ports 181 to the outflow opening 272 of the refrigerant feeder channel 27 become nearly the same and pressure variations at the outflow opening 272 are minimized. While Japanese Unexamined Utility Model Publication No. 64-56583 discusses positioning in a discharge chamber that minimizes pressure variations due to discharge pressure pulsation, the same argument applies to pressure variations due to suction pressure pulsation. Variations in the suction pressure at the outflow opening 272 are transmitted as suction pressure pulsation to the external refrigerant circuit 28 through the refrigerant feeder channel 27, causing the evaporator 31, installed in the interior of the vehicle, to vibrate at resonance frequency components contained in the suction pressure pulsation. Acoustic noise caused by vibration of the evaporator 31 is considerably reduced in this embodiment because the suction pressure pulsation is minimized. It has been ascertained that a noise component of about 1400 Hz, which is usually emitted by the evaporator 31 posing a substantial problem, could be reduced in this embodiment.

(1-3) The outflow opening 272 of the refrigerant feeder channel 27 has a slanting edge so that it opens toward the partition plate 18. This construction allows the refrigerant in the refrigerant feeder channel 27 to easily flow toward the suction ports 181, which is advantageous for minimizing pressure loss.

(1-4) If the outflow opening 272 of the refrigerant feeder channel 27 is too close to the partition plate 18, refrigerant streams flowing from the outflow opening 272 toward some of the suction ports 181 will meander excessively, resulting in an increase in pressure loss. The refrigerant feeder channel 27 is formed directly on the rear wall 172 of the suction chamber 22 to reduce suction pressure pulsation and the outflow opening 272 is located where it is uniformly separated from the individual suction ports 181 by a maximum distance. As a consequence, the degree of meandering of the refrigerant streams from the outflow opening 272 toward the suction ports 181 is reduced and the pressure loss is decreased.

(1-5) The earlier-described structure of the refrigerant feeder channel 27 in which its structural wall 271 is preferably formed as an integral part of the rear wall 172 of the suction chamber 22 is advantageous from the viewpoint of ease of manufacture and production cost, compared to a structure completed by assembling separate components.

(1-6) The refrigerant in the cylinder bores 111 pressurized during a discharge stroke tends to leak toward a low-pressure side through a gap between the valve-forming plate 19 and the end surface of the cylinder block 11, through a gap between the valve-forming plate 19 and the partition plate 18, and along the partition plate 18. A pushing force exerted by the multiple retaining projections 175 presses the partition plate 18, the valve-forming plates 19, 20 and the retainer-forming plate 21 toward the cylinder bores 111, thereby reducing leakage of the refrigerant from the cylinder bores 111 along the partition plate 18. The earlier-described structure in which the outflow opening 272 of the refrigerant feeder channel 27 is provided inside the circle C2 so that no retaining projections 175 are positioned between the outflow opening 272 and the individual suction ports 181 prevents the retaining projections 175 from interfering with refrigerant streams flowing from the outflow opening 272 toward the suction ports 181. It is therefore least likely that the refrigerant streams flowing from the outflow opening 272 to the suction ports 181 would be obstructed by the retaining projections 175.

(1-7) The structural wall 176 of the compartment 173 protruding out into the suction chamber 22 intersects the extended region of the refrigerant feeder channel 27 so that the refrigerant flowing out of the refrigerant feeder channel 27 into the suction chamber 22 is redirected by the structural wall 176 toward the partition plate 18. This redirecting effect of the structural wall 176 exerted on the refrigerant serves to smooth out its flow from the outflow opening 272 to the suction ports 181.

Figure 5A:
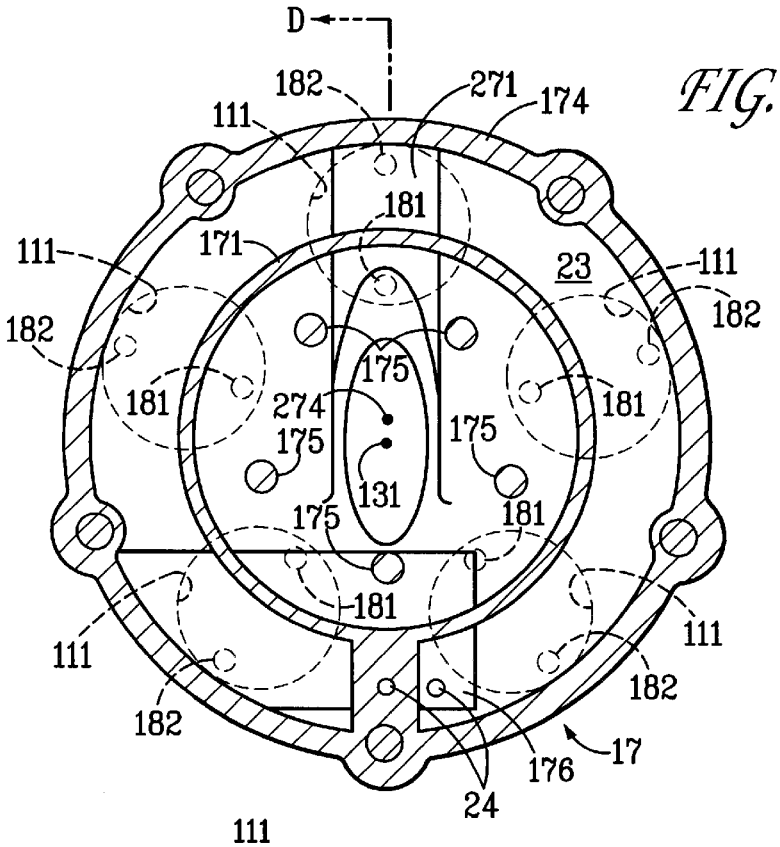
FIG. 5(*a*) is a vertical cross-sectional view showing a second exemplary embodiment of the invention.
Figure 5B:
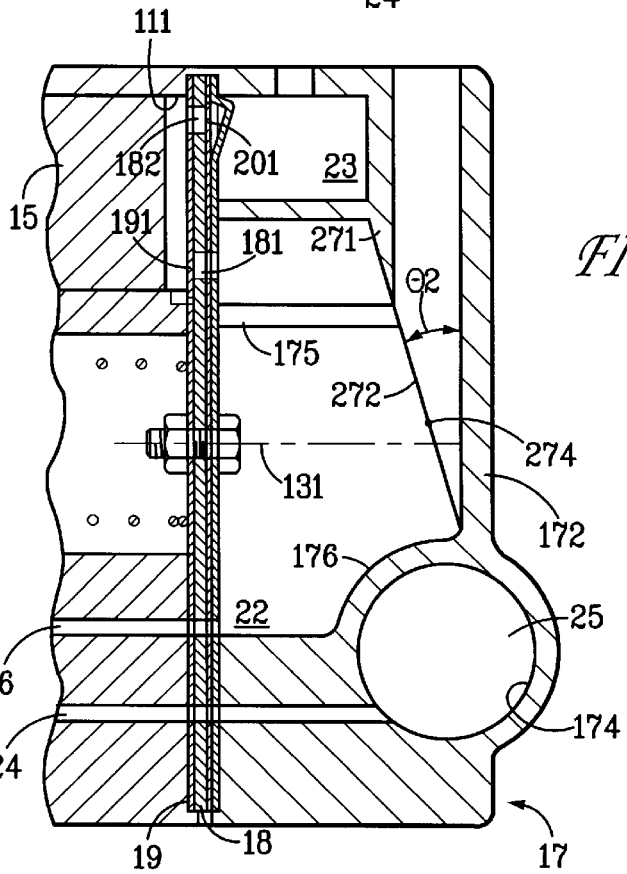

A second exemplary embodiment of the invention depicted in FIGS. 5(*a*) and 5(*b*) is now described, in which constituent parts identical to those included in the first embodiment are designated by the same reference numerals.

The slant angle θ2 of an outflow opening 272 of a refrigerant feeder channel 27 of this embodiment is made smaller than the slant angle θ1 of the first embodiment, and the outflow opening 272 is located so that its center 275 is offset from a longitudinal axis 131 of a rotary shaft 13. The outflow opening 272 is located inside a circle C2 along which a plurality of retaining projections 175 are arranged in a circular configuration.

Compared to the first embodiment, the flow of refrigerant toward suction ports 181 closer to the refrigerant feeder channel 27 (or the suction ports 181 located above the axis 131 as illustrated in FIG. 59(*a*)) becomes smoother in this embodiment.

Figure 6:
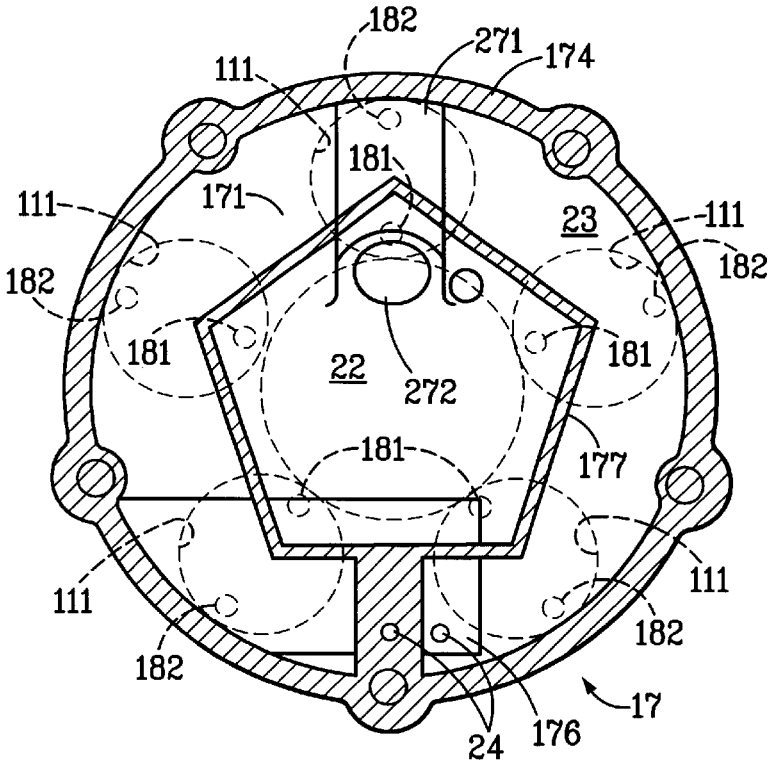
FIG. 6 is a vertical cross-sectional view showing an alternative exemplary embodiment of the invention.

An alternative embodiment of the invention is depicted in FIG. 6, in which the earlier-described retaining projections 175 are eliminated and a partition 177 having the shape of a regular polygon (an equilateral pentagon in the illustrated example) is employed. An outflow opening 272 of a refrigerant feeder channel 27 is offset from a longitudinal axis 131 of a rotary shaft 13.

Individual sides of the equilateral pentagonal shape of the partition 177 serve the same function as the retaining projections 175. The internal construction of a suction chamber 22 without the provision of the retaining projections 175 is advantageous for producing a smooth flow of refrigerant. The configuration in which the outflow opening 272 of the refrigerant feeder channel 27 is offset from the axis 131 of the rotary shaft 13 will not be so effective as the first embodiment in reducing suction pressure pulsation but will produce the same effect in reducing pressure loss. Inside the suction chamber 22, which can be regarded generally as a cylindrical cavity, pressure variations at the center of the equilateral pentagon, or at the axis 131 of the rotary shaft 13, are reduced. Thus, it is possible to obtain the effect of minimizing the suction pressure pulsation if the outflow opening 272 is positioned on the axis 131 of the rotary shaft 13.

Figure 7:
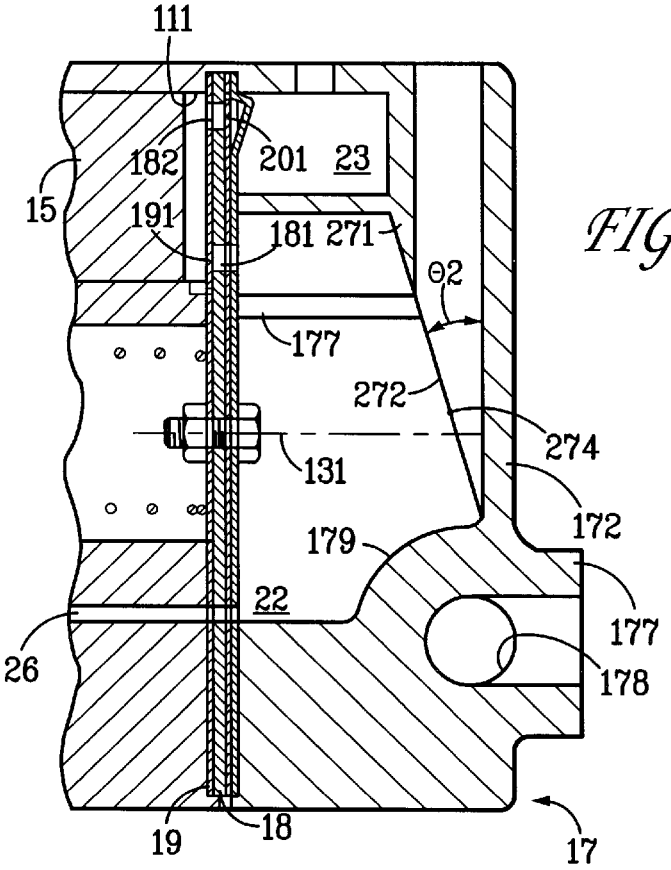
FIG. 7 is a fragmentary cross-sectional side view showing another alternative exemplary embodiment of the invention.

Another possible alternative embodiment of the invention is depicted in FIG. 7, in which a fixing part 177 is formed on a rear wall 172 of a rear housing 17. A bolt hole 178 is formed in the fixing part 177. A compressor of this embodiment is mounted to an external structure (e.g., a vehicle engine) by a bolt (not shown). A portion of the fixing part 177 bulges out into a suction chamber 22 forming a swollen part. An extended region of a refrigerant feeder channel 27 intersects a structural wall 179 of the fixing part 177. This embodiment produces the same effect as the first embodiment.

The present invention can be applied to a variable displacement compressor comprising a capacity control valve provided in a channel through which a refrigerant is drawn from a controlled pressure chamber into a suction chamber.

What is claimed is:

1. A compressor comprising:

a housing having an outer cylindrical wall;

a rotary shaft supported by said housing, said rotary shaft having a longitudinal axis;

a suction chamber formed in said housing proximate said longitudinal axis;

a discharge chamber formed in said housing around the outer periphery of said suction chamber; and a refrigerant feeder channel having a first end and a second end, wherein said first end of said refrigerant feeder channel is formed from said outer cylindrical wall, said refrigerant feeder channel extends across said discharge chamber in substantially a straight line to said second end, said second end opens into said suction chamber.

2. The compressor of claim 1 further comprising a suction outflow opening formed at said second end of said refrigerant feeder channel.

3. The compressor of claim 2 wherein said suction outflow opening is positioned in said suction chamber proximate said longitudinal axis.

4. The compressor of claim 2 wherein said outflow opening has a slanting edge, wherein said slanting edge opens toward said suction ports.

5. The compressor of claim 4 wherein said slanting edge has a slant angle of about 45 degrees.

6. The compressor of claim 4 wherein said slant angle is less than 45 degrees and said outflow opening is located in said suction chamber so that its center is offset from said longitudinal axis.

7. The compressor of claim 6 wherein the distances between said outflow opening and each of said plurality of suction ports is substantially the same.

8. The compressor of claim 1 further comprising a plurality of suction ports forming a circular arrangement, wherein a center of said circular arrangement is positioned on said longitudinal axis, and wherein said refrigerant feeder channel projects from a side wall of said suction chamber with said suction outflow opening directed toward said center of said circular arrangement along which said plurality of suction ports are formed.

9. The compressor of claim 1 wherein said suction chamber further comprising a rear wall, wherein said refrigerant feeder channel is formed along an inside surface of said rear wall.

10. The compressor of claim 1 wherein said refrigerant feeder channel is formed integral with said rear wall.

11. The compressor of claim 1 further comprising a swollen part formed on an inside surface of said rear wall of said suction chamber, wherein said swollen part bulges out into said suction chamber in such a way that an area of the inside surface of said rear wall of said suction chamber extended from said refrigerant feeder channel intersects said swollen part.

12. The compressor of claim 1 further comprising a retainer-forming plate and a plurality of retaining projections, wherein said plurality of retaining projections are formed in a second circular arrangement and extend from said rear wall of said suction chamber to said retainer-forming plate, and wherein each said plurality of retaining projections are positioned in between a plurality of lines extending from said outflow opening to each of said suction ports.

13. The compressor of claim 1 further comprising a partition having the shape of a regular polygon, wherein said partition is formed between and separating said suction chamber and said discharge chamber.

14. The compressor of claim 13 further comprising an outflow opening formed at said second end of said refrigerant feeder channel, wherein said outflow opening is offset from said longitudinal axis.

15. The compressor of claim 1 wherein said compressor is a variable displacement compressor.

16. The compressor of claim 15 wherein said variable displacement compressor is a swash plate type compressor.

17. A compressor comprising:

a housing having a rear housing, a cylinder block connected to a front end of said rear housing, a front housing connected to a front end of said cylinder block, and an outer cylindrical wall;

a rotary shaft supported by said cylinder block and said front housing, said rotary shaft having a longitudinal axis;

a suction chamber formed in said rear housing about said longitudinal axis;

a discharge chamber formed in said rear housing around the outer periphery of said suction chamber;

a refrigerant feeder channel having a first end and a second end, wherein said first end of said refrigerant feeder channel is formed from said outer cylindrical wall, said refrigerant feeder channel extends across said discharge chamber in substantially a straight line to said second end, said second end opens directly and continuously into said suction chamber; and a suction outflow opening formed in said second end of said refrigerant feeder channel; and wherein said suction outflow opening is positioned in said suction chamber proximate said longitudinal axis.

18. The compressor of claim 17 further comprising a plurality of suction ports forming a circular arrangement, wherein a center of said circular arrangement is positioned on said longitudinal axis, and wherein said refrigerant feeder channel projects from a side wall of said suction chamber with said suction outflow opening directed toward said center of said circular arrangement along which said plurality of suction ports are formed.

19. The compressor of claim 17 wherein the distances between said outflow opening and each of said plurality of suction ports is substantially the same.

20. The compressor of claim 17 wherein said outflow opening has a slanting edge, wherein said slanting edge opens toward said suction ports.

21. The compressor of claim 17 further comprising a rear wall and a swollen part formed on an inside surface of said rear wall of said suction chamber, wherein said swollen part bulges out into said suction chamber in such a way that an area of the inside surface of said rear wall of said suction chamber extended from said refrigerant feeder channel intersects said swollen part.

22. The compressor of claim 17 further comprising a retainer-forming plate and a plurality of retaining projections, wherein said plurality of retaining projections are formed in a second circular arrangement and extend from said rear wall of said suction chamber to said retainer-forming plate, and wherein each said plurality of retaining projections are positioned in between a plurality of lines extending from said outflow opening to each of said suction ports.

23. The compressor of claim 17 wherein said compressor is a variable displacement compressor.

24. The compressor of claim 23 wherein said variable displacement compressor is a swash plate type compressor.

25. A compressor comprising:

a housing having a rear housing, a cylinder block connected to said rear housing, a front housing connected to said cylinder block, and an outer cylindrical wall;

a rotary shaft supported by said cylinder block and said front housing, said rotary shaft having a longitudinal axis;

a suction chamber formed in said rear housing about said longitudinal axis;

a discharge chamber formed in said rear housing around the outer periphery of said suction chamber;

a refrigerant feeder channel having a first end and a second end, wherein said first end of said refrigerant feeder channel is formed in said outer cylindrical wall, said refrigerant feeder channel extending in a substantially straight line across said discharge chamber to said second end formed in said suction chamber, a suction outflow opening formed in said second end of said refrigerant feeder channel;

wherein said suction outflow opening is located in said suction chamber proximate said longitudinal axis;

a plurality of suction ports forming a circular arrangement, wherein a center of said circular arrangement is positioned on said longitudinal axis, and wherein said refrigerant feeder channel projects from a side wall of said suction chamber with said suction outflow opening directed toward said center of said circle along which said plurality of suction ports are formed;

wherein the distances between said outflow opening and each said plurality of suction ports is substantially the same; and wherein said outflow opening has a slanting edge, wherein said slanting edge opens toward said suction ports.

26. The compressor of claim 25 further comprising a rear wall and a swollen part formed on an inside surface of said rear wall of said suction chamber, wherein said swollen part bulges out into said suction chamber in such a way that an area of the inside surface of said rear wall of said suction chamber extended from said refrigerant feeder channel intersects said swollen part.

27. The compressor of claim 26 further comprising a retainer-forming plate and a plurality of retaining projections, wherein said plurality of retaining projections are formed in a second circular arrangement and extend from said rear wall of said suction chamber to said retainer-forming plate, and wherein each said plurality of retaining projections are positioned in between a plurality of lines extending from said outflow opening to each of said suction ports.

28. The compressor of claim 26 wherein said compressor is a variable displacement compressor.

29. The compressor of claim 28 wherein said variable displacement compressor is a swash plate type compressor.

30. A compressor comprising:

a housing having a front, a rear, an outer cylindrical wall, a front housing, a cylinder block, and a rear housing;

a rotary drive shaft having a longitudinal axis, said rotary shaft rotatably supported by said cylinder block and said front housing;

a plurality of cylinder bores formed in a circular arrangement around the longitudinal axis of said drive shaft;

a plurality of pistons disposed in said plurality of cylinder bores and caused to move by rotational motion of said drive shaft;

a partition plate disposed on a rear surface of said cylinder block;

a suction chamber formed in said rear housing block proximate said longitudinal axis;

a discharge chamber formed in said rear housing block around the outer periphery of said suction chamber;

a plurality of suction ports formed in said partition plate and connecting said plurality of cylinder bores to said suction chamber;

a plurality of discharge ports formed in said partition plate and connecting said plurality of cylinder bores to said discharge chamber; and a refrigerant feeder channel having a first end and a second end, said first end formed in said outer cylindrical wall, said refrigerant feeder channel extending from said outer cylindrical wall across said disharge chamber in a substantially straight line to said suction chamber, said second end opens into said suction chamber.

31. The compressor of claim 30 further comprising a suction outflow opening formed in said refrigerant feeder channel on said second end.

32. The compressor of claim 31 wherein said suction outflow opening is located in said suction chamber proximate said longitudinal axis.

33. The compressor of claim 31 wherein said outflow opening has a slanting edge, wherein said slanting edge opens toward said suction ports.

34. The compressor of claim 30 wherein said plurality of suction ports are formed in a circular arrangement, wherein a center of said circular arrangement is positioned on said longitudinal axis, and wherein said refrigerant feeder channel projects from a side wall of said suction chamber with said suction outflow opening directed toward said center of said circle along which said plurality of suction ports are formed.

35. The compressor of claim 34 wherein the distances between said outflow opening and each of said plurality of suction ports is substantially the same.

36. The compressor of claim 30 further comprising a rear wall and a swollen part formed on an inside surface of said rear wall of said suction chamber, wherein said swollen part bulges out into said suction chamber in such a way that an area of the inside surface of said rear wall of said suction chamber extended from said refrigerant feeder channel intersects said swollen part.

37. The compressor of claim 30 further comprising a retainer-forming plate and a plurality of retaining projections, wherein said plurality of retaining projections are formed in a second circular arrangement and extend from said rear wall of said suction chamber to said retainer-forming plate, and wherein each said plurality of retaining projections are positioned in between a plurality of lines extending from said outflow opening to each said suction port.

38. The compressor of claim 30 wherein said compressor is a variable displacement compressor.

39. The compressor of claim 38 wherein said variable displacement compressor is a swash plate type compressor.

40. A compression system comprising a compressor connected to an external refrigerant circuit, said compressor comprising:

a housing having a longitudinal axis and an outer cylindrical wall;

a suction chamber formed about said longitudinal axis;

a discharge chamber formed around the outer periphery of said suction chamber;

a refrigerant feeder channel formed in said housing, said refrigerant feeder channel having a first end and a second end, said refrigerant feeder channel extending from said first end formed as an opening in said outer cylindrical wall across said discharge chamber to said second end opening in said suction chamber;

means for reducing pressure losses in said refrigerant feeder channel;

means for reducing rotational torque in said compressor; and means for reducing the longitudinal length of said compressor.

41. The system of claim 40 wherein said means for reducing pressure losses further comprises said refrigerant feeder channel being formed in a substantially straight line from said outer cylindrical wall, extending across said discharge chamber, and opening into said suction chamber.

42. The system of claim 40 wherein said means for reducing rotational torque further comprises a suction outflow opening formed in said second end of said refrigerant feeder channel, wherein said outflow opening is positioned proximate said longitudinal axis.

43. The system of claim 40 further comprising a plurality of suction ports formed in a circular arrangement, wherein each of said plurality of suction ports is positioned at substantially the same distance from said outflow opening.

44. The system of claim 40 wherein said means of reducing the longitudinal length further comprises forming said first end of said refrigerant feeder channel in said outer cylindrical wall, and forming said refrigerant feeder channel across said discharge chamber.

* * * * *